US005715601A

United States Patent [19]

Nakatani et al.

[11] Patent Number: 5,715,601

[45] Date of Patent: Feb. 10, 1998

[54] RECIPROCATORY DRY SHAVER

[75] Inventors: Mitsuo Nakatani; Takashi Yoneda; Yoshinobu Takegawa; Toshio Ikuta, all of Hikone; Manabu Kawara, Otsu, all of Japan

[73] Assignee: Matsushita Electric Works, Ltd., Kadoma, Japan

[21] Appl. No.: 652,918

[22] Filed: May 24, 1996

[30] Foreign Application Priority Data

May 26, 1995 [JP] Japan ..... 7-128548

[51] Int. Cl.[6] ..... B26B 19/04

[52] U.S. Cl. ..... 30/43.92; 30/346.51

[58] Field of Search ..... 30/43.9, 43.92, 30/45, 43.91, 43.8, 346, 51

[56] References Cited

U.S. PATENT DOCUMENTS

| | | | |
|---|---|---|---|
| 4,428,117 | 1/1984 | Horii et al. | 30/43.9 X |
| 5,343,621 | 9/1994 | Hilderbrand et al. | 30/43.92 |
| 5,414,930 | 5/1995 | Muller et al. | 30/43.92 X |
| 5,463,813 | 11/1995 | Otsuka et al. . | |
| 5,557,850 | 9/1996 | Mun | 30/43.92 |

FOREIGN PATENT DOCUMENTS

WO 93/12916 7/1993 WIPO .

OTHER PUBLICATIONS

German Patent Office Action for German application No. 196 21 415.7–15 dated Jul. 5, 1996 (with translation).

*Primary Examiner*—Douglas D. Watts

*Attorney, Agent, or Firm*—Armstrong, Westerman, Hattori, McLeland & Naughton

[57] ABSTRACT

A reciprocatory dry shaver is capable of providing a drive point of transmitting a reciprocating force to an inner cutter from a drive element at a location as close as to a cutting edge of the inner cutter for enhancing cutting performance, yet making the use of a plastic made drive element to give a detachable connection with the inner cutter. The shaver comprises a housing incorporating a drive source which is connected to move a drive element projecting on top of the housing. An outer cutter is supported to the top of the housing. An inner cutter is detachably connected to the drive element and is driven thereby to reciprocate in hair shearing engagement with the outer cutter. The drive element comprises a stud and a pin which projects beyond the upper end of the stud. The inner cutter is formed with a joint for detachable connection to the stud and with a catch for detachable connection to the pin. The catch is formed upwardly of the joint to define a drive point at the connection with the pin where the drive element transmits a driving force of reciprocating the inner cutter. With this arrangement, the driving point can be disposed closer to an upper cutting edge of the inner cutter than a connection point of detachably holding the inner cutter to the drive element. Consequently, a driving force is effectively applied for hair shaving between the reciprocating inner cutter and the outer cuter, thereby enhancing cutting performance.

13 Claims, 9 Drawing Sheets

50
52
52
50
52
52
51
51
54
53
60
53
60
33
33
31
34
31
44
44
42
41
30
30
21
21
20
10

RECIPROCATORY DRY SHAVER

BACKGROUND OF THE INVENTION

1. Field of the Invention

The present invention is directed to an reciprocatory dry shaver, and more particularly to a mechanism of transmitting a reciprocating force to an inner cutter of the shaver.

2. Description of the Prior Art

A reciprocatory dry shaver has an inner cutter which is driven by a drive element to reciprocate in shearing engagement with an outer cutter. For replacement and cleaning purposes, the inner cutter is required to be detachably connected to the drive element projecting on top of a shaver. housing. In order to make the inner cutter detachable to the drive element, it has been a common practice to make the use of a plastic material for giving resilient deformability to the drive element at the connection with the inner cutter.

In the meanwhile, there has been always a demand of attaining a smooth shaving or improved shaving efficiency. One approach is to locate a driving point of transmitting a force of reciprocating the inner cutter from the drive element as close as possible to a cutting edge of the inner cutter. As the driving point is displaced away from the upper cutting edge, there develops a greater difference in contacting pressure of the inner cutter against the outer cutter between at the leading end and the trailing end of the reciprocating inner cutter, the reason of which will be clear from a later discussion. In other words, the contact pressure becomes less at the trailing end and greater at the leading end of the reciprocating inner cutter as the driving point is spaced away by greater distance from the cutting edge. Such greater difference in the contact pressure would be impedance to a smooth reciprocating motion of the inner cutter and therefore result in lowering of the cutting efficiency. This is particularly critical when the inner cutter is driven at a high speed. Consequently, the drive point must be located as dose as possible to the cutting edge of the inner cutter for assuring smooth shaving at an improved cutting efficiency.

Further, the inner cutter is preferred to be floatingly supported to the drive element so as to be depressed together with the outer cutter for optimum cutting performance. For this purpose, the drive element is required to have a great amount of projection, i.e., length. However, when the drive element is made long while it is made of the plastic material to give resilient deformability at a connecting end to the inner cutter, the drive element suffers from reduced rigidity and therefore fails to transmit the driving force effectively to the inner cutter, thus lowering the cutting efficiency.

SUMMARY OF THE INVENTION

The present invention has been achieved in view of the above problems and provides an improved reciprocatory dry shaver which is capable of providing a drive point of transmitting a reciprocating force to an inner cutter from a drive element at a location as close as to a cutting edge of the inner cutter for enhancing cutting performance, yet making the use of a plastic made drive element to give a detachable connection with the inner cutter. The reciprocatory dry shaver in accordance with the present invention comprises a housing incorporating a drive source which is connected to move a drive element projecting on top of the housing. An outer cutter is supported to the top of the housing. An inner cutter is detachably connected to the drive element and is driven thereby to reciprocate in hair shearing engagement with the outer cutter. The drive element comprises a stud and a pin which projects beyond the upper end of the stud. The inner cutter is formed with a joint for detachable connection to the stud and with a catch for detachable connection to the pin. The catch is formed upwardly of the joint to define a drive point at the connection with the pin where the drive element transmits a driving force of reciprocating the inner cutter. With this arrangement, the driving point can be disposed closer to an upper cutting edge of the inner cutter than a connection point of detachably holding the inner cutter to the drive element. Consequently, a driving force is effectively applied for hair shaving between the reciprocating inner cutter and the outer cuter, thereby enhancing cutting performance.

The pin is made of a rigid metal to give enough rigidity to effectively transmit the driving force to the inner cutter, while the drive element is made of a plastic material to have a resiliently deformable upper end with latches for detachably engaging with a corresponding finger at the lower end of the joint of the inner cutter. Therefore, the driving force is effectively transmitted to the inner cutter through the rigid pin and at the same time the inner cutter can be made detachable to the drive element by the use of resiliency come from the plastic made drive element.

In a preferred embodiment, the joint and the catch are slidably engaged respectively with the stud and the pin so that the inner cutter is slidable along a common upright axis of the pin. The drive element includes a spring for urging the inner cutter upwardly to floatingly support the inner cutter. During the floating movement of the inner cutter, the catch can be kept in contact with the pin to transmit the reciprocating force to the inner cutter constantly from the drive element. The stud of the drive element is formed with a top open cavity through which the pin extends. The spring is disposed within the cavity around the pin and is held between the bottom of the cavity and a retainer slidably carried on the pin. The retainer is formed to have opposite edges which are spaced in a reciprocating direction of the inner cutter and are slidably engaged with corresponding edges of the cavity. The pin extends through the spring to thereby prevent the spring from warping when the spring is compressed by the inner cutter, thereby assuring a stable spring bias over a long period of use. Further, since the opposed edges of the retainer are kept in sliding engagement with the drive element, the drive element can serve to sustain the pin if the pin suffers from an excessive force to be otherwise bent. Accordingly, the pin can be held stable to give a reliable shaving operation. The stud is formed with stoppers for engagement with the retainer. The stoppers are formed at the upper end of the stud and are separated from the latches in such a relation that the retainer is kept engaged with the stoppers when the upper end of the stud is resiliently deformed to allow the detachment of the inner cutter from the stud, or drive element. Therefore, the retainer can be avoided from escaping away from the drive element when disengaging the inner cutter from the stud by resiliently deforming the upper end of the stud.

The inner cutter is held slidable along the axis of the stud between an operative position and an inoperative position. In the operative position which is an actual shaving position, the inner cutter is depressed together with the outer cutter against the bias of the spring with the latches being kept disengaged from the fingers. In the inoperative position where the outer cutter is removed away from the inner cutter, the inner cutter is biased by the spring to an uppermost end while being kept connected with the stud by engagement between the latches and the fingers of the joint. The catch is provided in the form of a cylinder having a hole through which the pin extends. The cylinder has a lip formed at the upper end of the hole for engagement with the pin in such a manner as to define the drive point as well as to allow said inner cutter to be inclined with respect to the axis of the stud when the inner cutter is in the operative position. Thus, the inner cutter is allowed to be inclined dating the shaving operation in order to well conform to a contour of a user's skid. When the inner cutter is moved to the inoperative position, it is locked with the stud by engagement of the latches with the fingers to be thereby made unable to be inclined with respect to the axis of the stud. Therefore, cleaning of the inner cutter is made without causing any substantial pivotal movement of the inner cutter relative to the stud, and therefore can be made without causing noise or parts wearing that would otherwise occur.

The cylinder is formed to have a diameter of the hole which is greater towards the bottom end of the cylinder than at the upper end. With the provision of thus flared hole, the pin can be easily guided firstly into the hole and finally into engagement with the lip for driving connection to the inner cutter.

The cylinder is formed at its upper end with a slit which extends horizontally in a direction perpendicular to the reciprocating direction of the inner cutter. With this slit, the upper end of the cylinder defining the driving point can be resiliently deformed in such a manner as to be kept in constant engagement with the pin. That is, when the inner cutter is inclined relative to the axis of the pin, the slit allows to the upper end of the cylinder to resiliently deform in conformity with the sectional configuration of the inclined pin at the contact with the pin. In addition, with the use of thus resilient deformability given to the upper end of the cylinder, the pin can be engaged with the cylinder in a somewhat press fitted manner, giving a detachable but secure connection of the pin to the inner cutter for smoothly transmitting the reciprocating force to the inner cutter.

The cylinder is formed at its lower end with a pair of notches which are spaced in the reciprocating direction of the inner cutter. The notch has such a width as to allow the pin to escape therethrough when the inner cutter is being detached from the drive element in an inclined relation with respect to the axis of the stud. Consequently, the cylinder can be prevented from being damaged by the pin during a manipulation of detaching the inclined inner cutter from the drive element.

The joint is preferably in the form of a frame with a rectangular bottom socket into which the stud fits. It is this frame that provides the above fingers at four corners of the rectangular socket for detachable engagement respectively with the latches on the drive clement. With the use of the frame structure for the joint, the joint can enjoy increased rigidity for firm connection to the drive element.

The cylinder is displaced upwardly from the fingers by a such a distance that the pin becomes engaged with said cylinder before the stud extends into the socket. Therefore, the pin and catch combination can acts as a guidance to register the latches with the fingers for easy engagement thereof at the time of attaching the inner cutter to the drive element.

When the inner cutter is in the inoperative position, the pin is disengaged from the lip of the cylinder such that, when the inner cutter in the inoperative position is driven to reciprocate, the lip can be kept intact from the pin and therefore can be prevented from wearing which would otherwise develop and fail to maintain reliable driving connection between the pin and the joint. In the inoperative position, the latches of the stud come into engagement with the fingers of the joint to give an alternate driving point thereat, thereby enabling the inner cutter to reciprocate, for example, in the water for cleaning of the inner cutter. During this cleaning, the lip of the cylinder can be kept out of contact from the pin and be therefore free from wearing. Thus, the lip of the cylinder defining the drive point can be kept intact for reliable shaving operation over a long period of use.

In another embodiment, the cylinder is formed at a portion downwardly of the lip with a flange which comes into driving engagement with the pin when the inner cutter moves to the inoperative position for transmitting the reciprocating force to the inner cutter. With the provision of the flange, the inner cutter can be driven for cleaning purpose without causing any loss or undue frictional movement between the drive element and the inner cutter, particularly at the connection between the latches and the fingers. Consequently, the inner cutter can be driven to reciprocate without causing any substantial noise or frictional wearing, facilitating the cleaning of the inner cutter while protecting the plastic-made lip, fingers, and latches from wearing.

These and still other objects and advantageous features will become more apparent from the following description of the preferred embodiments when taken into conjunction with the attached drawings.

DETAILED DESCRIPTION OF THE EMBODIMENTS

Figure 1:
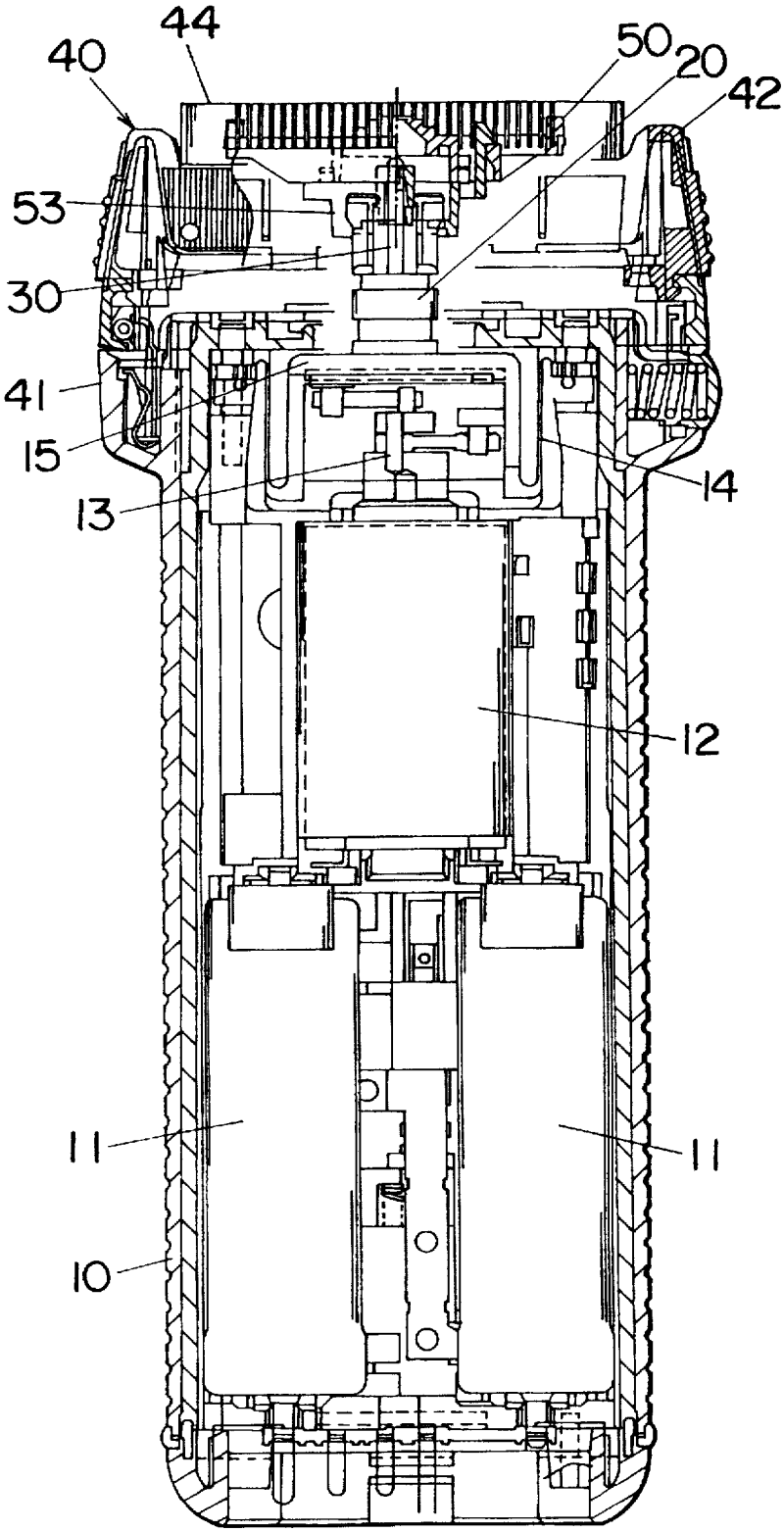
FIG. 1 is a front sectional view of a reciprocatory dry shaver in accordance with one embodiment of the present invention.
Figure 2:
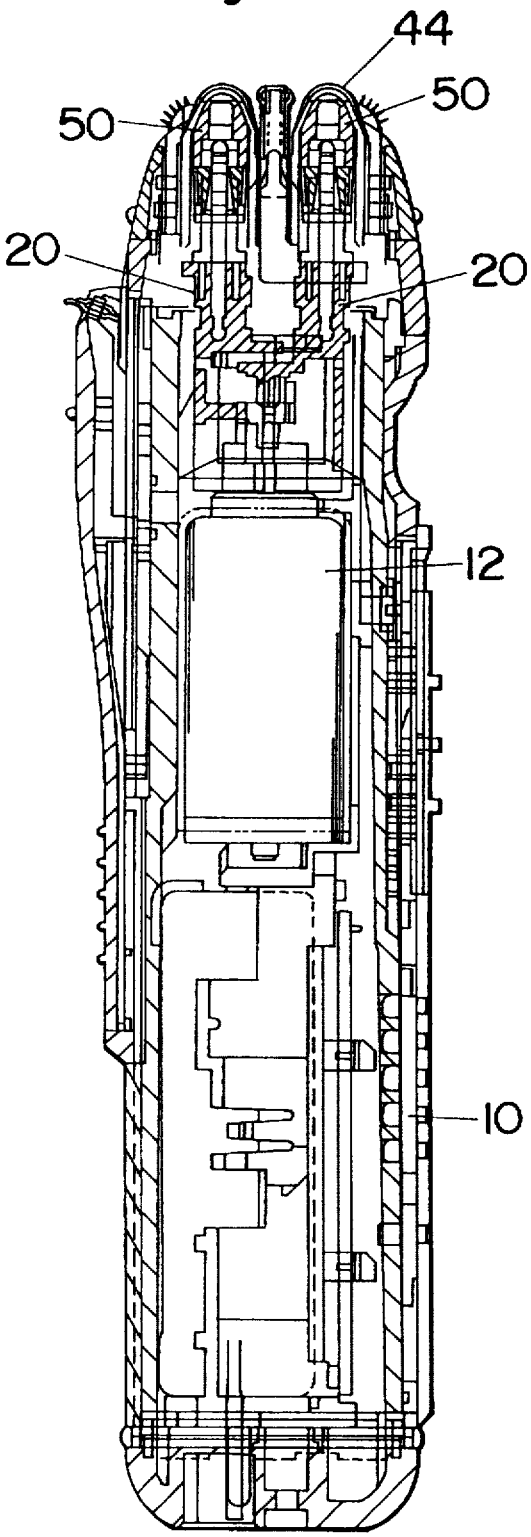
FIG. 2 is a side sectional view of the dry shaver.
Figure 3:
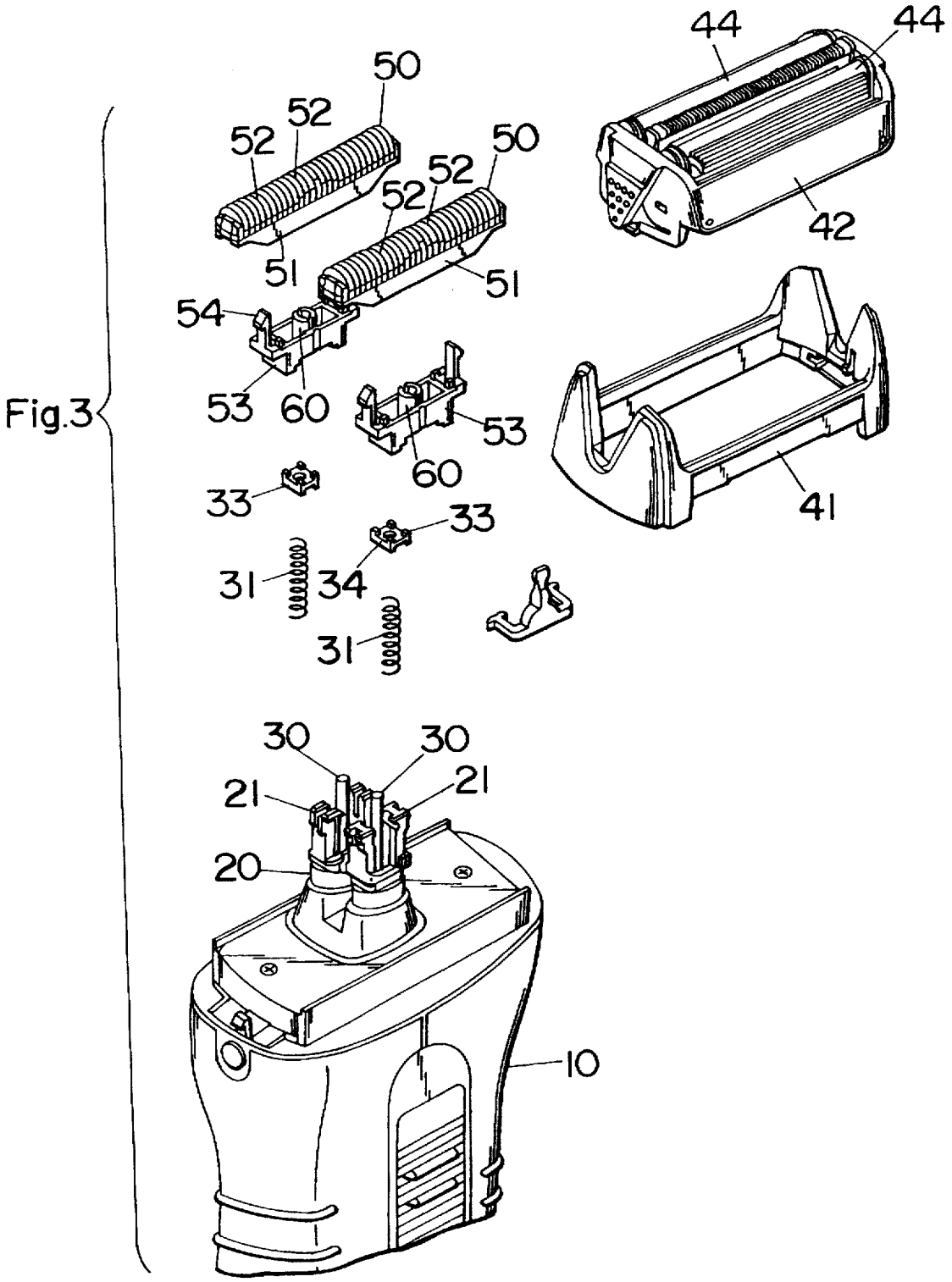
FIG. 3 is an exploded perspective view of a cutter head of the shaver.
Figure 4:
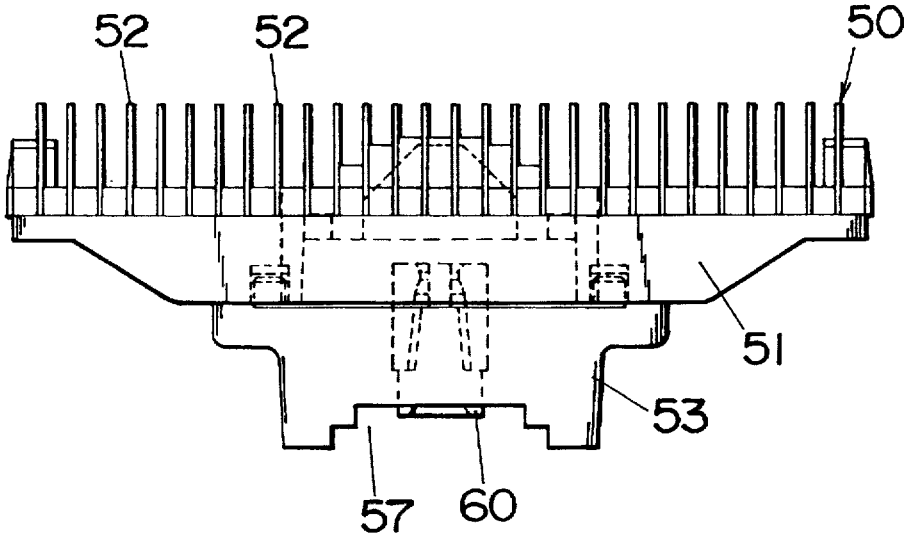
FIG. 4 is a front view of an inner cutter of the shaver.

Referring now to FIGS. 1 to 3, there is shown a reciprocatory dry shaver in accordance with a preferred embodiment of the present invention. The dry shaver comprises a shaver housing 10 and a shaving head 40 mounted on top of the housing. The housing 10 incorporates a rechargeable battery 11, an electric rotary motor 12 powered by the battery, and a motion-converter 14 which converts a rotary motion of an output shaft 13 of the motor into a reciprocatory motion of drive elements 20 projecting on top of the housing 10. The shaving head 40 comprises a support frame 41 held on top of the housing 10, a cutter holder 42 detachably connected to the support frame 41 and holding a pair of outer cutters 44, and a pair of inner cutters 50 detachably connected to the drive elements 20 to be driven thereby to reciprocate in hair shearing engagement with the outer cutters 44.

Figure 5:
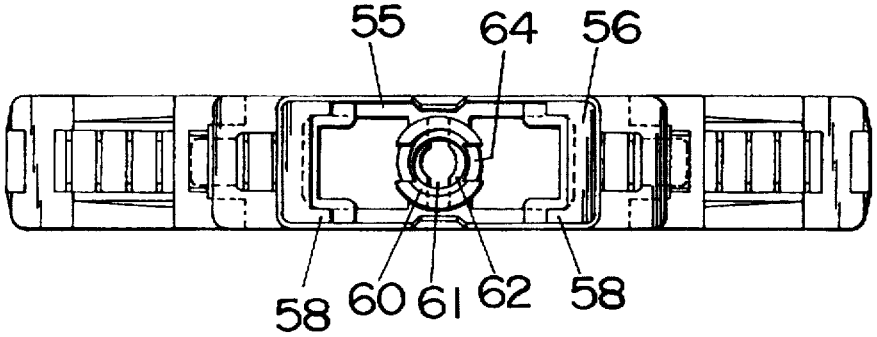
FIG. 5 is a bottom view of the inner cutter.
Figure 6:
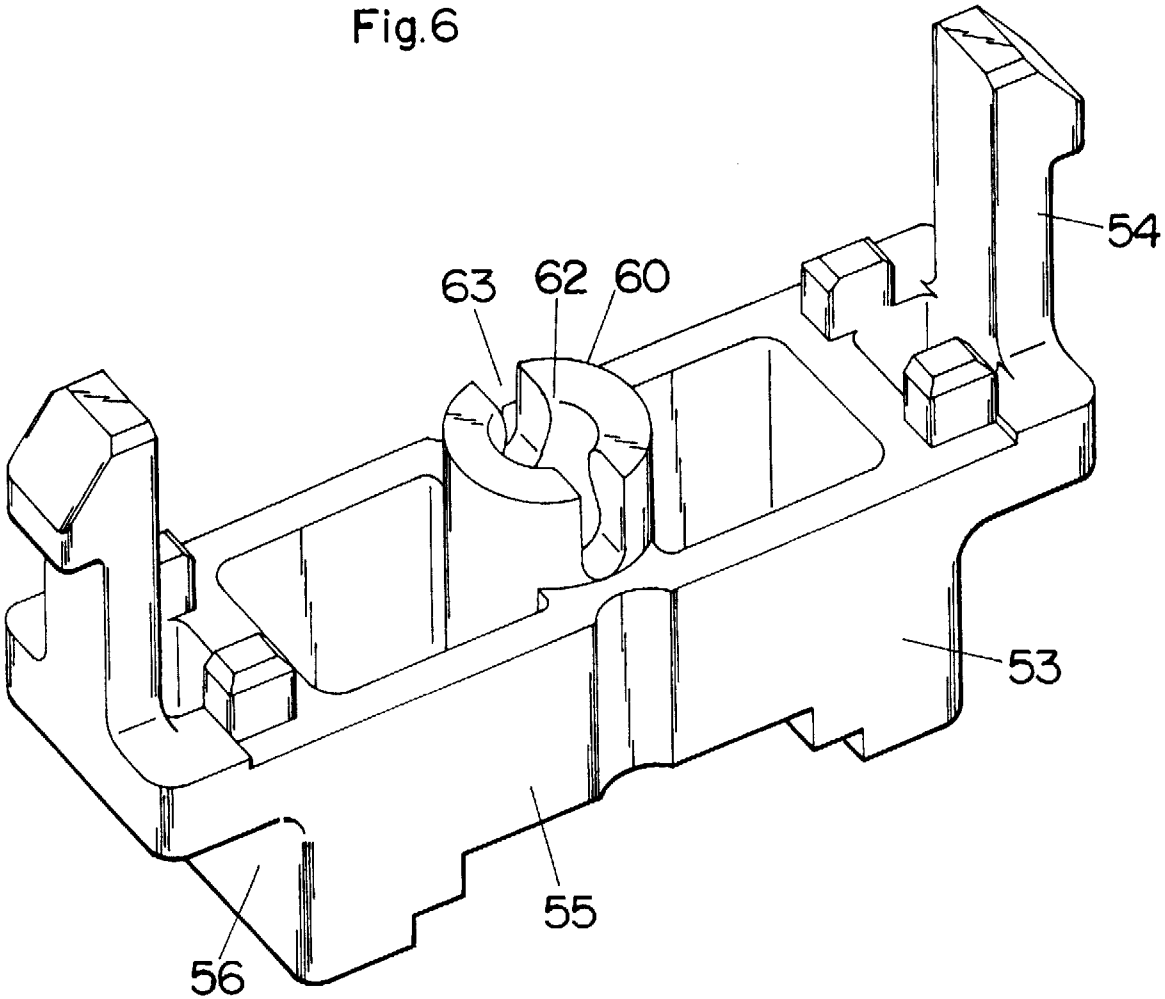
FIGS. 6 and 7 are perspective views of the inner cutter, respectively as viewed from top and bottom.
Figure 7:
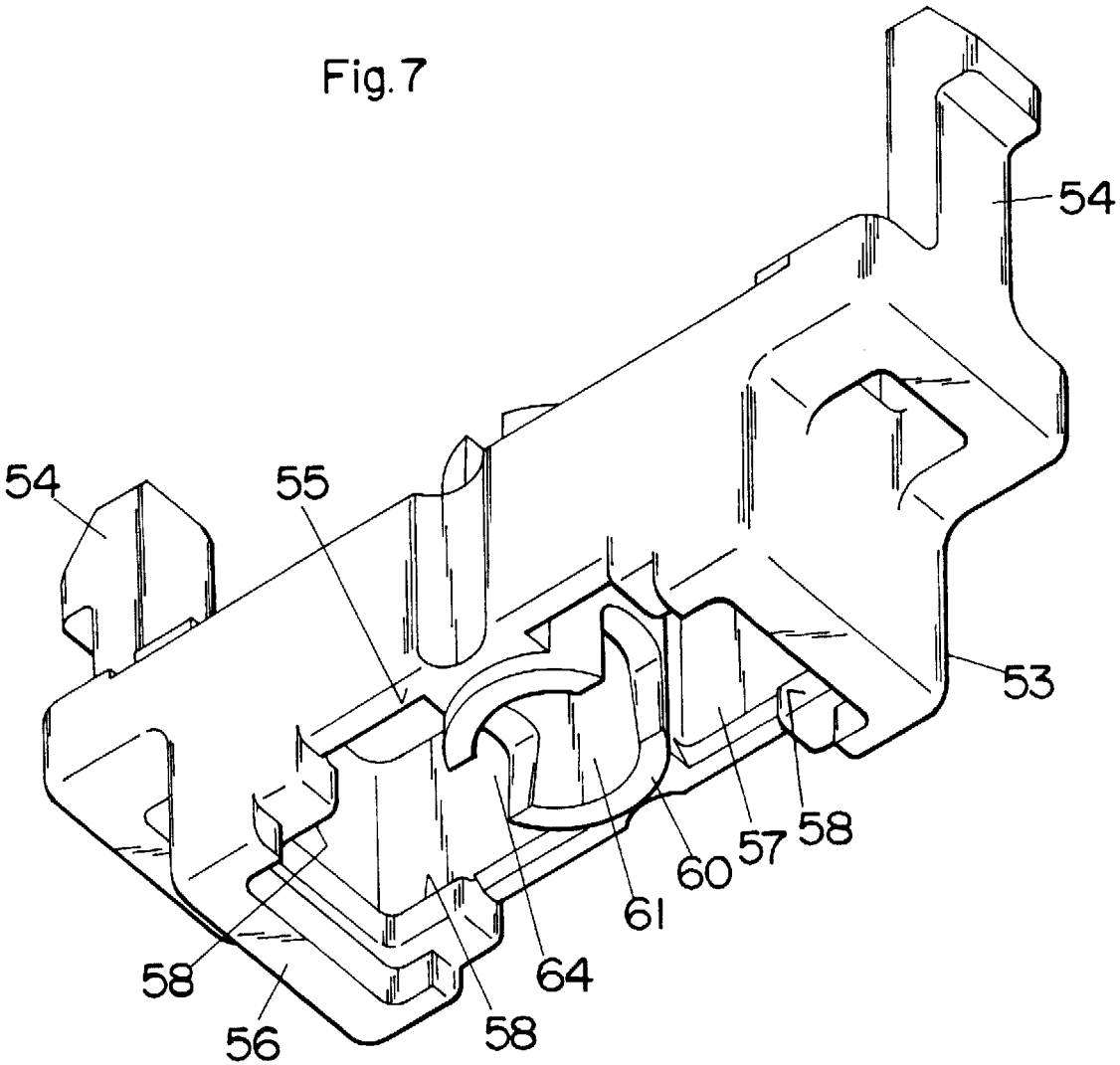

As shown in FIGS. 3 and 5, the inner cutter 50 comprises an elongated base 51 carrying a plurality of evenly spaced blades 52, and a joint 53 secured to the lower center of the base for detachably connecting the inner cutter 50 to the drive element 20. Each blade 52 has an arcuate cutting edge curved in conformity with the outer cutter 44. The joint 53 has a pair of hooks 54 which are tightly engaged with corresponding portions of the base 51 to form a rigid unitary construction. As best shown in FIGS. 6 and 7, the rectangular body of the joint 53 comprises a pair of opposite side walls 55 connected by end walls 56 to have in its bottom a socket 57 into which an upper end of the drive element 20 projects for detachably connecting the inner cutter to the drive element, the detail of which will be discussed later. Integrally and centrally formed between the opposite side walls is a catch in the form of a cylinder 60 for establishing a driving connection between the drive element 20 and the inner cutter 50. The detailed structure of the cylinder 60 and the associated features will be explained later in conjunction with the structure of the drive element 20.

Figure 8:
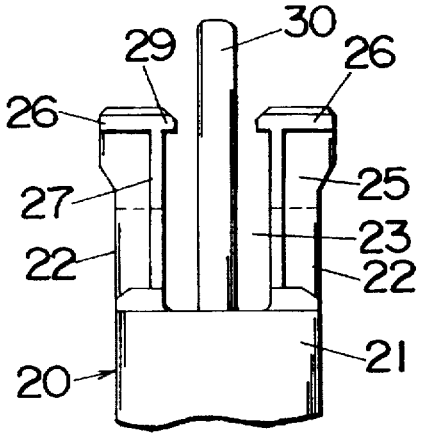
FIG. 8 is front view of a top portion of a drive element for driving the inner cutter.
Figure 11:
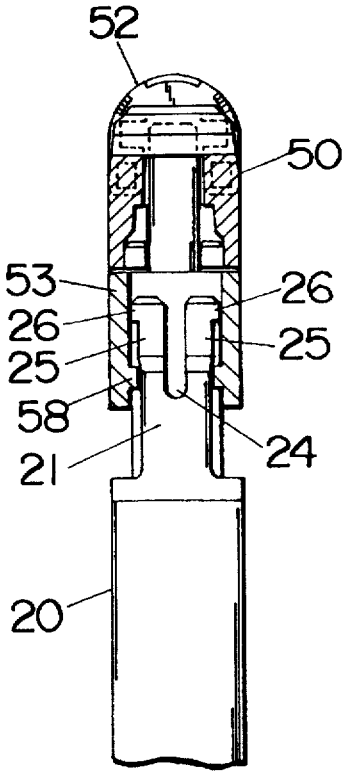
FIGS. 10 and 11 are front and side sectional views respectively illustrating the connection of the inner cutter with the drive element.
Figure 9:
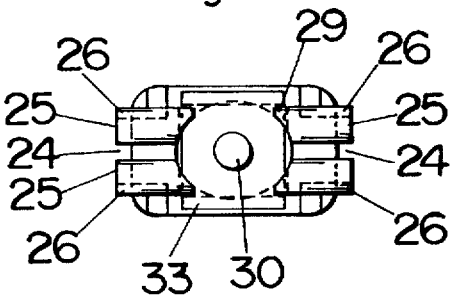
FIG. 9 is a top view of the drive element.
Figure 10:
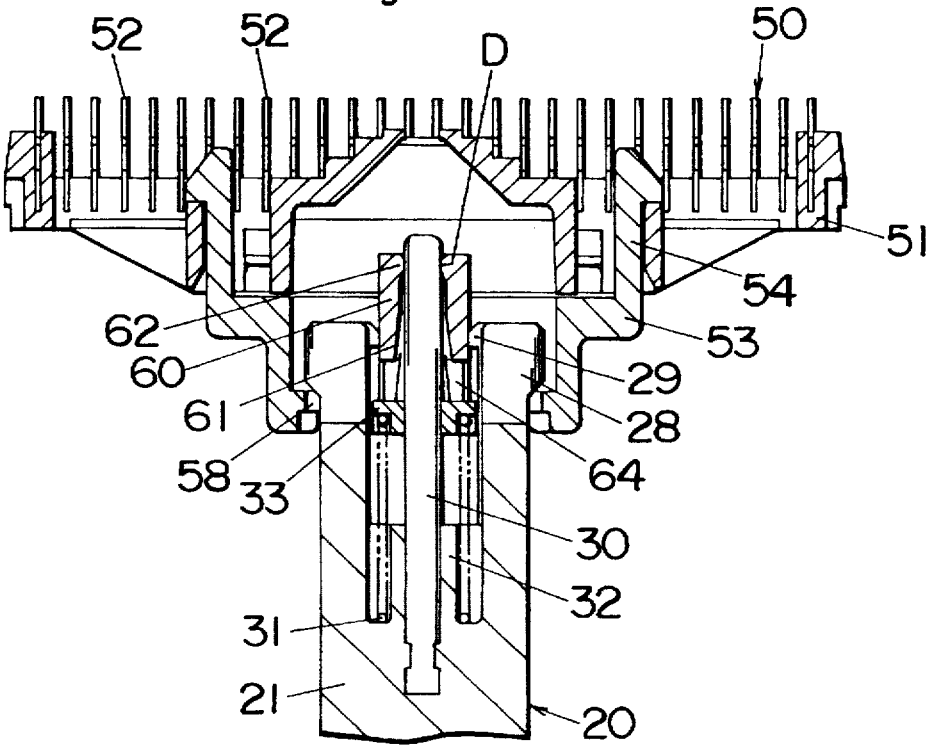

As shown in FIGS. 8 to 10, the drive element 20 comprises a stud 21 and a pin 30 which extends in alignment with the stud 11 and has its lower end anchored into the lower end of the stud 21 for rigid connection thereto. The stud 21 is made of a plastic material and projects integrally from a reciprocator 15 of the motion-converter 14 on top of the housing 10. The upper end of the stud 21 is bifurcated to have a pair of parallel prongs 22 leaving therebetween a top-open cavity 23 through which the pin 30 extends. As shown in FIGS. 9 and 11, each of the prongs 11 is further formed with a slit 24 to divide the upper end of the prong 21 into resilient legs 25 capable of resiliently deforming in a direction perpendicular to the reciprocating direction of the drive element 20. Thus obtained four resilient legs 15 are each formed at its upper end with a latch 26 projecting on opposite of the slit 24 for engagement with each one of fingers 58 formed in four corners of the socket 57 of the joint 53, as shown in FIG. 11, thereby establishing the detachable connection of the inner cutter 50 to the drive element 20. The connection and disconnection of the inner cutter 50 to and from the drive element 20 is made as a result of inherent resiliency coming from the plastic material of the stud 21 and the presence of the slit 25 in combination. A rib 27 is formed on the exterior of the prongs 22 to reinforce the stud in such a manner as to prevent the prongs 22 from deflecting in the reciprocating direction of the drive element 20.

It is the pin 30 that extends into a vertical hole 61 of the cylinder 60 of the joint 53 to define a drive point of transmitting a force of reciprocating the inner cutter 50 from the drive element 20. A spring 31 is disposed around the pin 30 within the cavity 23 to give an upward bias for urging the inner cutter 50 against the outer cutter 44 to develop a suitable contacting pressure therebetween. For this purpose, the spring 31 is held compressed between the bottom of the cavity 23 and a retainer 33 which is slidably fitted on the pin 30 and comes into pressed contact with the lower end of the cylinder 60, thereby the inner cutter 50 receives the upward bias at the abutting connection of the retainer 33 to the cylinder 60. A boss 32 is formed on the bottom of the cavity 23 to fit into the lower end of the spring 31.

Figure 14:
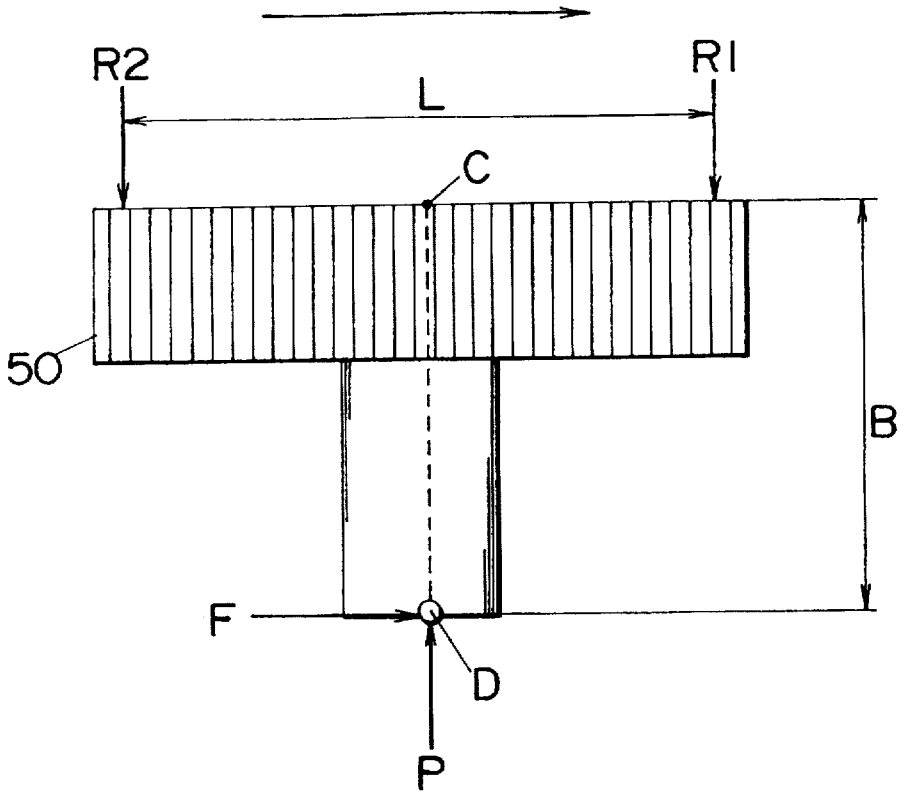
FIG. 14 is a diagram illustrating a relation between a distance B from the drive point to a cutting edge of the inner cutter and contacting pressures R1 and R2 developed on the inner cutter at its leading end trailing end in the reciprocating direction.

As shown in FIG. 10, the pin 30 is engaged with a lip 62 projecting inwardly at the upper end of the hole 61 of the cylinder 60 to defined thereat the drive point which is closer to the cutting edge of the inner cutter 50 than the lower end of the joint 53, i.e., a connection point of the inner cutter 50 to the drive element 20. Such disposition of the drive point close to the cutting edge of the inner cutter 50 is found advantageous in achieving improved cutting performance. FIG. 14 illustrates a relation between a distance B from the drive point D to the cutting edge of the inner cutter 50 and contacting pressures R1 and R2 developed on the inner cutter at its leading end trailing end in the reciprocating direction when the inner cutter receives a driving force F at the drive point D while receiving the upward bias P from the spring 31. It is derived from the a model of FIG. 14 that contacting pressures R1 and R2 results from the upward bias P. That is, $$P=R1+R2$$

Considering a moment around the longitudinal center C of the cutting edge, a following equation results:

$$R2\times L/2+B\times F-R1\times L/2=0$$

where L is a length of the inner cutter, i.e. between the leading and trailing end of the inner cutter respectively developing the contacting pressure R1 and R2.

Combination of these equations gives rise to following two expressions:

$$R1=P/2+B\times F/L$$

$$R2=P/2-B\times F/L$$

As apparent from the above, the contacting pressure R2 at the trailing end of the inner cutter suffers from a greater decrease as the distance B is made greater, while the contacting pressure R1 at the leading end of the inner cutter receives a greater increase, thereby developing a larger difference of the contacting pressures between at the leading and trailing ends of the inner cutter with the increasing distance B and therefore causing significant unbalancing of the contacting pressure eventually leading to a jerky movement and therefore unsatisfactory cutting performance. Accordingly, it is desired to locate the drive point D as close as possible to the cutting edge of the inner cutter. This is achieved in the present invention where the pin 30 projects upwardly of the stud 21 for driving engagement with the cylinder 60 upwardly of the fingers 58 of the joint 54 which defines a connection point of connecting the inner cutter to the stud 21. That is, the pin 30 projects deep into the inner cutter to have the drive point upwardly of the connection point so that the drive point can be closer to the cutting edge than the connection point, thereby assuring improved cutting performance.

Further, since the drive point is defined separately from the connection point, the lip 62 of the plastic-made cylinder 60 defining the drive point can be kept intact when connecting and disconnecting the inner cutter to and from the drive element for assuring a reliable driving connection of the inner cutter over a long period of use.

The pin 30 is made of a metal or the like material having sufficient rigidity so that the driving force can be effectively transmitted to reciprocate the inner cutter 50. In this connection, the retainer 33 has its opposite edges held in sliding contact with interior concave surfaces of the prongs 22, as shown in FIGS. 9 and 10 so as to reinforce the pin in a direction of preventing the pin from deforming in the reciprocating direction even when the pin 30 suffers from an excessive load from the inner cutter 50 during the shaving. The upward movement of the retainer 33 by the bias of the spring 30 is limited due to engagement of the retainer with stoppers 29 formed at the stud 21. The stopper 29 are each formed at the inner upper end of the resilient leg 25 to project inwardly into the cavity 23. Therefore, when the resilient legs 25 are deformed to connect and disconnect the inner cutter 50 to and from the stud 21 by narrowing the slits 24, the stoppers 29 can be kept in engagement with the retainer 33, thereby preventing an accidental removal of the retainer 33 during the connection and disconnection of the inner cutter to and from the drive element 20. The retainer 33 is formed with a rim 34 which is engaged with the upper end of the spring 30 to securely hold the same.

Figure 12:
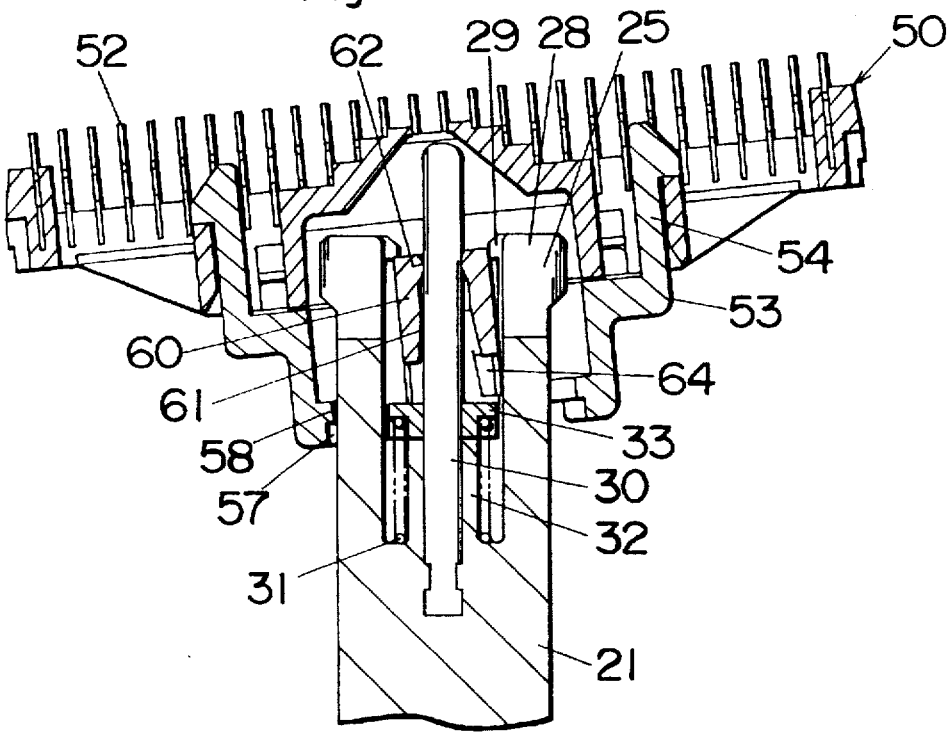
FIG. 12 is a front sectional view explaining a condition where the inner cutter is depressed by a maximum extent and inclined as seen in an actual shaving operation.
Figure 13:
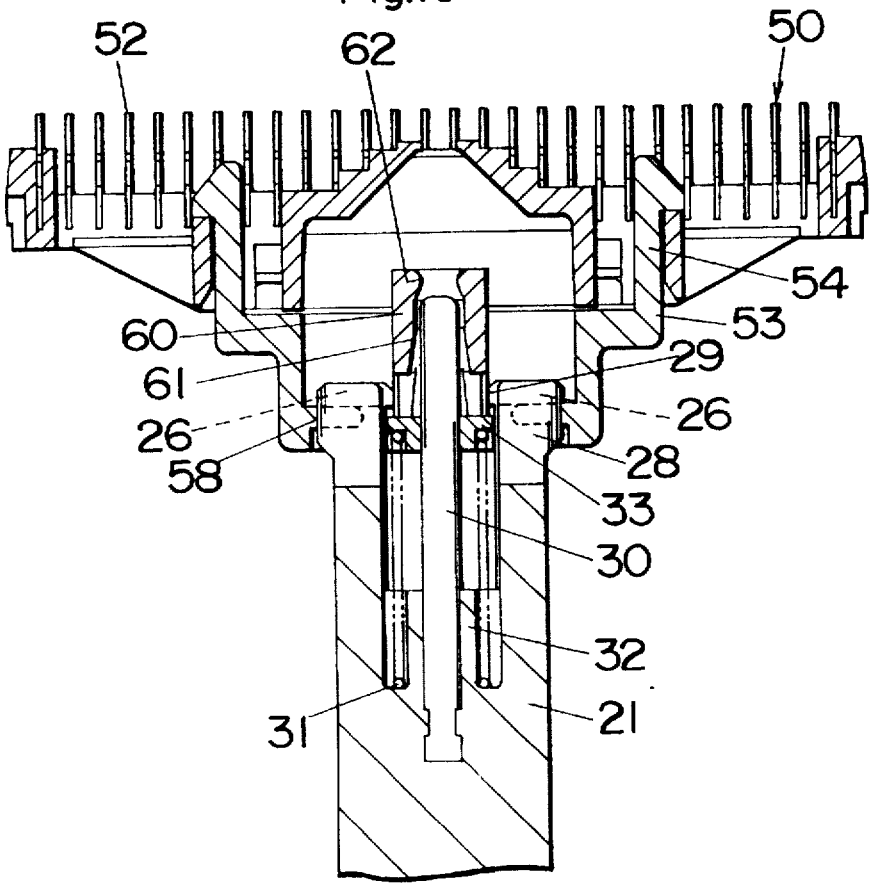
FIG. 13 is a front sectional view explaining a condition where the inner cutter is displaced to its uppermost position as a result of the outer cutter being removed.

When the inner cutter 50 is held in an operative position of shaving the hairs, the spring 30 is compressed to some extent so as to give a suitable contact pressure between the inner cutter and the outer cutter as well as to floatingly support the inner cutter 50, as shown in FIG. 10. In this connection, the outer cutter 44 is floatingly supported to the holder 42 so that the outer cutter is allowed to depress together with the inner cutter 50 against the bias of the spring 30. In this position, the latches 26 are kept disengaged from the corresponding fingers 58 of the joint 50 and at the same time the whole upper end of the stud 21 is spaced from the interior surface of the socket 57 by some clearance so that the inner cutter 50 is allowed to be tilted to a limited extent relative to an upright axis of the stud 21. Also in this connection, the outer cutter 44 is supported to the holder 42 so as to be capable of tilting to some extent. Therefore, the outer cutter 44 and the inner cutter 50 are together enabled to conform to a contour of the skin during the shaving. The tilting movement of the inner cutter 50 is possible until the inner cutter 50 is depressed to a maximum extent, as shown in FIG. 12. As shown from the figure, the inner cutter 50 is tilted to a maximum extent when the lower edge of the socket 57 comes into abutment with the stud ill. The stud 21 is formed at its upper end with bulges 28 projecting on the legs 25 which come into abutment with the inner edge of the socket 57 when the inner cutter 50 is held at its uppermost position, which is an inoperative position, as shown in FIG. 13, where the outer cutter 44 is removed away from the inner cutter 50. In this position, the upper end of the pin 30 remains within the cylinder 60 but is kept away from the wall of the cylinder 60, while the latches 26 comes into engagement with the fingers 58 of the socket 57 to give an alternative drive point of transmitting the reciprocating force from the stud 29 to the inner cutter 50. Therefore, the inner cutter 50 be still capable of being driven to reciprocate although not for the shaving purpose. During such reciprocation of the inner cutter 50, the pin 30 is kept out of contact from the lip 62 as well as the other portion of the cylinder 60. Thus, the lip 62 can be free from wearing and ensure reliable driving connection of the inner cutter in the operative position over a long period of use.

With the provision of the bulges 28, the inner cutter 50 in the inoperative position is locked upright so as to be prevented from inclining to a large extent. Thus, the inner cutter 50 can be detached from the drive element 20 without suffering from waving, i.e., in a manner not to cause pivoting of the inner cutter which would otherwise impede easy and safe replacement of tile inner cutter. Also with this horizontal lock of the inner cutter, cleaning of the inner cutter can be successfully made by driving the inner cutter in a water without causing any substantial jerky movement or tilting movement which would otherwise bring about undue friction and wearing at the connection of the inner cutter with the drive element. As a matter of course, since the inner cutter can be held stable in tile inoperative position, it can be easily cleaned by the use of a brush or the like.

As shown in FIG. 6, the cylinder 60 is formed in its upper end with a slit 62 which extends horizontally in a perpendicular relation to the length of the inner cutter, i.e., the reciprocating direction thereof, thereby giving resilient deformability to the upper end of the cylinder 60 where the inward projecting lip 62 is formed to be responsible for the driving connection to the drive element 20. Thus, when the inner cutter 50 is tilted the upper end of the cylinder 60 is correspondingly deformed so as to assure constant engagement of the lip 62 with the pin 30 for successfully driving the inner cutter even at the tilted condition. That is, the upper end of the hole 61 which is normally of a circular configuration is allowed to be shaped into an ellipse in conformity with a corresponding section of the pin 30 as the inner cutter 50 tilts. It is noted in this connection the lip 62 is kept in sliding engagement with the pin 30 so as to allow the inner cutter to be floatingly supported to the drive element, yet ensuring a constant driving engagement of the cylinder 60 to the pin. The hole 61 of the cylinder 60 has a diameter which is greater towards the bottom than at a portion immediately below the lip 62 so that, when connecting the inner cutter 50 to the drive element, the pin 30 is easily guided into the cylinder 60 for engagement at the lip 62.

Further, as shown in FIG. 7, the cylinder 60 is formed in its bottom with a pair of notches 64 aligned in the longitudinal direction, i.e., the reciprocating direction of the inner cutter 50. The notch 64 has a width which allows the pin 30 to escape therethrough when the inner cutter 50 is detached from the drive element 20 in a direction deviating from an axial direction of the drive element 20, thereby eliminating possibility of collision between the pin and the wall of the cylinder 60 which would otherwise damage the cylinder 60 and eventually lead to the failure of connecting the inner cutter.

Figure 15:
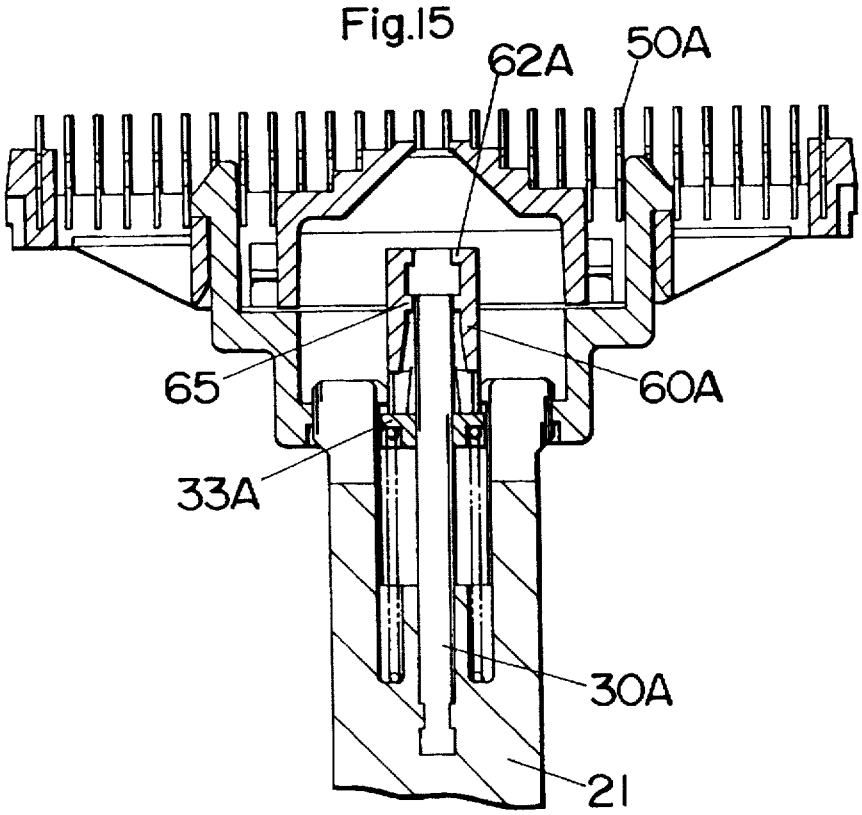
FIG. 15 is a front sectional view of a dry shaver in accordance with another embodiment of the present invention.

FIG. 15 illustrates a dry shaver in accordance with another embodiment of the present invention which is identical in structure and operation to the above embodiment except that the inner cutter 50A in the inoperative position is held in a positive driving connection with the pin 30A without causing any substantial gap between the pin 30A and the cylinder 60A. For this purpose, the cylinder 60A is formed additionally with a flange 65 at a portion below the lip 62A which comes into close engagement with the pin 30A when the inner cutter 50A moves into the inoperative position, as shown in the figure, whereby the inner cutter 50A can be driven to reciprocate even in the inoperative position but without developing undesired friction particularly at the connection between the latches 26 and the fingers 58 which would otherwise cause wearing of the plastic-made components, i.e., latches 26, fingers 58A. Like parts are designated by like numerals with a suffix letter of "A".

What is claimed is:

1. A reciprocatory dry shaver, comprising:

a housing incorporating a drive source which is connected to move a drive element projecting on top of said housing;

an outer cutter supported to the top of said housing; and an inner cutter detachably connected to said drive element and driven thereby to reciprocate in hair shearing engagement with said outer cutter, wherein said driven element comprises a stud and a pin projecting beyond the upper end of said stud, said pin being made of a rigid metal and said stud being made of a plastic material to have a resiliently deformable upper end, said resiliently deformable upper end having a latch for detachably engaging with a corresponding finger at the lower end of a joint, wherein said inner cutter formed with another joint for detachable connection to said stud and formed with a catch for detachable connection to said pin, and wherein said catch is formed upwardly of said another joint to a drive point at the connection with a pin where said drive element transmits a driving force of reciprocating said inner cutter.

2. The dry shaver as set forth in claim 1, wherein said pin extends along an axis of said stud, said joint and said catch being slidably engaged respectively with said stud and said pin so that said inner cutter slidable along an axis of said stud, said drive element including a spring for urging said inner cutter upwardly, thereby floatingly supporting said inner cutter.

3. The dry shaver as set forth in claim 2, wherein said stud is formed with a top open cavity through which said pin extends, said spring being disposed within said cavity around said pin and held between the bottom of said cavity and a retainer slidably carried on said pin, said retainer having opposite edges which are spaced in a reciprocating direction of said inner cutter and are slidably engaged with corresponding edges of said cavity.

4. The dry shaver as set forth in claim 2, wherein said stud is formed with a stopper for engagement with said retainer, said stopper being formed at the upper end of said stud and being separated from said latch in such a relation that the retainer is kept engaged with said stopper when the upper end of the stud is resiliently deformed to allow the detachment of said inner cutter from said stud.

5. The dry shaver as set forth in claim 2, wherein said inner cutter being slidable along the axis of said stud between an operative position where said inner cutter is depressed together with said outer cutter against the bias of said spring with said latch being kept disengaged from said finger and an inoperative position where said inner cutter is biased upwardly by said spring and kept connected with said stud by engagement between said latch of the stud and said finger of said joint, said inner cutter assuming said inoperative position when said outer cutter is removed away from said inner cutter, said catch is in the form of a cylinder with a hole through which said pin extends, said cylinder having a lip which is formed at the upper end of said hole for engagement with said pin in such a manner as to define said drive point as well as to allow said inner cutter to be inclined with respect to the axis of said stud when said inner cutter is in said operative position, said inner cutter being locked with said stud by engagement of the latch with said finger when said inner cutter is in said inoperative position, thereby being unable to be inclined with respect to the axis of said stud.

6. The dry shaver as set forth in claim 5, wherein said hole of said cylinder has a diameter which is greater towards the bottom end of the cylinder than at the upper end.

7. The dry shaver as set forth in claim 5, wherein said cylinder is formed at its upper end with a slit extending horizontally in a direction perpendicular to said reciprocating direction of said inner cutter, said lip being deformed on either side of said slit.

8. The dry shaver as set forth in claim 5, wherein said cylinder is formed at its lower end with a pair of notches which are spaced in the reciprocating direction of said inner cutter and have such a width as to allow said pin to escape therethrough when said inner cutter is being detached from said drive element in an inclined relation with respect to the axis of said stud.

9. The dry shaver as set forth in claim 1, wherein said joint is in the form of a fringe with a rectangular bottom socket into which said stud fits, said frame having said fingers at four corners of said socket for detachable engagement respectively with said latches.

10. The dry shaver as set forth in claim 6, wherein said joint is in the form of a frame with a rectangular bottom socket into which said stud fits, said frame having said fingers at four corners of said socket for detachable engagement respectively with said latches, said cylinder being displaced upwardly from said finger by a such a distance that the pin becomes engaged with said cylinder before said stud extends into said socket.

11. The dry shaver as set forth in claim 5, wherein said pin is disengaged from said lip to keep the lip intact from said pin when said inner cutter is in said inoperative position.

12. The dry shaver as set forth in claim 11, wherein said latch of the stud comes into engagement with said finger of the joint when said inner cutter is in said inoperative position, thereby establishing a driving connection of enabling said inner cutter in said inoperative position to reciprocate.

13. The dry shaver as set forth in claim 11, wherein said cylinder is formed at a portion downwardly of said lip with a flange which comes into engagement with said pin when said inner cutter moves to said inoperative position for transmitting the drive force from said pin to said inner cutter.

* * * * *